US007992359B2

(12) United States Patent
Sill

(10) Patent No.: US 7,992,359 B2
(45) Date of Patent: Aug. 9, 2011

(54) ALIGNMENT BRACE FOR INSULATED CONCRETE WALLS AND METHOD OF CONSTRUCTION

(76) Inventor: Glenn E. Sill, Woodland Park, CO (US)

( * ) Notice: Subject to any disclaimer, the term of this patent is extended or adjusted under 35 U.S.C. 154(b) by 337 days.

(21) Appl. No.: 12/323,855

(22) Filed: Nov. 26, 2008

(65) Prior Publication Data

US 2010/0126084 A1 May 27, 2010

(51) Int. Cl.
*E04G 21/00* (2006.01)
*E04B 1/16* (2006.01)

(52) U.S. Cl. ..... 52/742.14; 52/127.2; 52/127.3; 52/425; 52/562; 52/745.05; 248/354.1; 248/354.4; 248/354.6

(58) Field of Classification Search ..... 52/127.2, 52/127.3, 425, 426, 428, 562, 742.14, 745.05, 52/745.09, 745.1, 749.1; 248/354.1, 354.4, 248/354.6
See application file for complete search history.

(56) References Cited

U.S. PATENT DOCUMENTS 3,788,026 A * 1/1974 Cook ..... 52/127.2
5,956,906 A * 9/1999 Berich et al. ..... 52/149
7,275,731 B1 * 10/2007 Shinault ..... 249/216
7,617,640 B2 * 11/2009 Bradley ..... 52/127.2
7,913,463 B2 * 3/2011 Russell ..... 52/127.2
2002/0073634 A1 * 6/2002 Bolinger et al. ..... 52/127.2
2006/0080937 A1 * 4/2006 Jones ..... 52/749.1
2008/0202043 A1 * 8/2008 Marshall et al. ..... 52/127.2
2008/0302045 A1 * 12/2008 Roach ..... 52/426
2009/0057518 A1 * 3/2009 Russell ..... 248/354.1
2009/0078843 A1 * 3/2009 Trotter ..... 248/354.1
2009/0095878 A1 * 4/2009 Way ..... 249/132
2009/0229205 A1 * 9/2009 Bradley ..... 52/309.12
2010/0005736 A1 * 1/2010 Dayton et al. ..... 52/127.2
2010/0037538 A1 * 2/2010 Sorich ..... 52/127.2

* cited by examiner

*Primary Examiner* — Brian Glessner
*Assistant Examiner* — Rodney Mintz
(74) *Attorney, Agent, or Firm* — Richard W. Hanes; Hanes Hrbacek & Bartels LLC

(57) ABSTRACT

An alignment brace for multi-level insulated concrete form walls that utilizes a cured base level wall for anchoring the brace that will be used to brace and align a succeeding wall level comprising, a bracing beam having first and second sections that are pivotally interconnected at a pivot point, an elongated adjustment beam disposed in spaced relation from the bracing beam and co-planar therewith where the adjustment beam is pivotally interconnected to the bracing beam at the pivot point and where the adjustment beam carries at its distal ends a jack screw assembly for expanding or contracting the spacing between the distal ends of the adjustment beam and the bracing beam.

3 Claims, 6 Drawing Sheets

ALIGNMENT BRACE FOR INSULATED CONCRETE WALLS AND METHOD OF CONSTRUCTION

FIELD OF THE INVENTION

The present invention relates generally to insulated concrete wall construction and more particularly to a bracing device for supporting and aligning a tall wall during forming and concrete pouring operations.

BACKGROUND OF THE INVENTION

Insulated concrete forms are stay-in-place forms for energy efficient cast-in-place reinforced concrete walls. The forms comprise interlocking modular units that are dry stacked (without mortar) and filled with concrete. The modular units lock together and, when assembled, create a double sided form for the structural concrete walls of a building. Most of such forms are made of foam insulation, such as expanded polystyrene, and are comprised of either separate panels interconnected with plastic or steel connectors (commonly called webs or ties) or they may be pre-formed interlocking blocks whose lateral sides are interconnected with the plastic or steel ties. Concrete is pumped into the cavity between an assembly of modules to form the structural element of the walls. Usually, reinforcing steel is added before the concrete is poured to give the resulting walls flexural strength. After the concrete has cured the forms are left in place permanently to provide thermal and acoustic insulation, among other things.

For walls up to approximately eight feet tall the most common method of construction is to stack the modules and brace the wall in the traditional manner, then pour the concrete. For walls of a greater height two options are available. The first is pouring the wall in stages. That is, when the concrete in the eight foot wall is cured the bracing is stripped and scaffolding is tied into the wall. Then the process is begun again, bracing the scaffolding and the wall for the next level. The second option is to form and brace the entire wall and make a single pour. While the second option has the advantage of employing a concrete pump truck only once, the disadvantages are severe. Furthermore, current bracing technology generally limits the height of the wall to around twenty-four feet. Because current bracing systems all depend on a vertical member such as a ladder or beam disposed flush with the wall and which is braced with a plurality of diagonal braces extending from spaced positions on the vertical member to respective anchor points on the ground, there is insufficient rigidity in a manageably sized diagonal brace to support and align a wall of greater height than 24 feet.

As commercial ICF construction has become more popular the question of how to brace and align walls over 24 feet high has become more urgent. Accordingly, the primary object of the present invention is to provide a brace and alignment tool for use in constructing tall insulated concrete form walls.

A second object of the invention is to provide bracing for insulated concrete form walls that eliminates need for diagonal members that bear against the ground for support.

Another object of the invention is to provide a bracing assembly for insulated concrete form walls that are constructed in successive levels and which can plumb a successive level of the wall by adjustment of the brace even though the previous poured level of the wall might be out of plumb.

Other objects, features and advantages of the present invention will become apparent upon a reading of the following detailed description of a preferred form of the invention taken in connection with the accompanying drawings.

SUMMARY OF THE INVENTION

The preferred form of apparatus of the present invention comprises a bracing beam comprising first and second sections that are hinged together at the mid-point of the beam. To accomplish its bracing function in constructing an insulated concrete form tall wall, the first section of the beam is disposed vertically and flush with the outside surface of the modules that comprise the wall form on that portion of the wall that has already been poured and cured. The first section of the bracing beam is secured to the poured wall by connectors, such as screws, between the first section of the beam and the webs or ties that lie imbedded in the foam insulation comprising the sides of the ICF module. Preferably, a plurality of screw or other type of connection is made between the bracing beam and each module. The second section of the bracing beam extends from the top of the poured concrete level upwardly and is connected in like manner to the ties of the ICF modules that have been stacked on the poured wall section for creating the insulated concrete form for the next successive level of the wall.

If the bracing beam were only a single piece, as in the prior art, then any amount by which the poured wall is out of plumb would be magnified for the next successive wall level. Accordingly, the hinged joint between the first and second sections of the bracing beam of the present invention allows the second section to be pivoted with respect to the first section and thereby adjusted to a plumb position. The adjustment of the second section is accomplished through the use of an adjusting beam that is positioned over and spaced apart from the bracing beam and in alignment therewith. The adjusting beam is supported in its position by a bracket that is attached to the mid-point of the adjusting beam and pivotally connected to the bracing beam at the hinge point between the two sections of the bracing beam. The pivotal connection between the adjusting beam and the bracing beam allows the adjusting beam to pivot around the same hinge axis as the first and second sections of the bracing beam. Movement of the adjusting beam to correct for plumb errors is created by manipulation of a manual adjustment devices, such as a jack screws that interconnect the distal ends of the two sections of the bracing beam with the distal ends of the adjusting beam. Operation of the adjusting devices brings the adjusting beam ends closer to or further apart from the respective ends of the bracing beam sections. The adjusting devices can be manipulated so as to rotate the second section of the bracing beam around its hinge point so that the second section and the ICF modules to which it is attached are plumb. The process of attaching a brace to a cured level of a multi-level wall in order to brace the next level is repeated so as to construct multi-level tall wall.

Depending on the length of the wall, a plurality of the bracing beams will be required along spaced intervals to provided support and alignment over the entire length of the insulated wall.

Because each level of a multi-level wall receives its bracing support and alignment from the poured level beneath it, tall ICF walls may be constructed without the limitations inherent in diagonal ground supports. Accordingly, ICF walls above 24 feet may be built utilizing the apparatus and method of the present invention.

Figure 1:
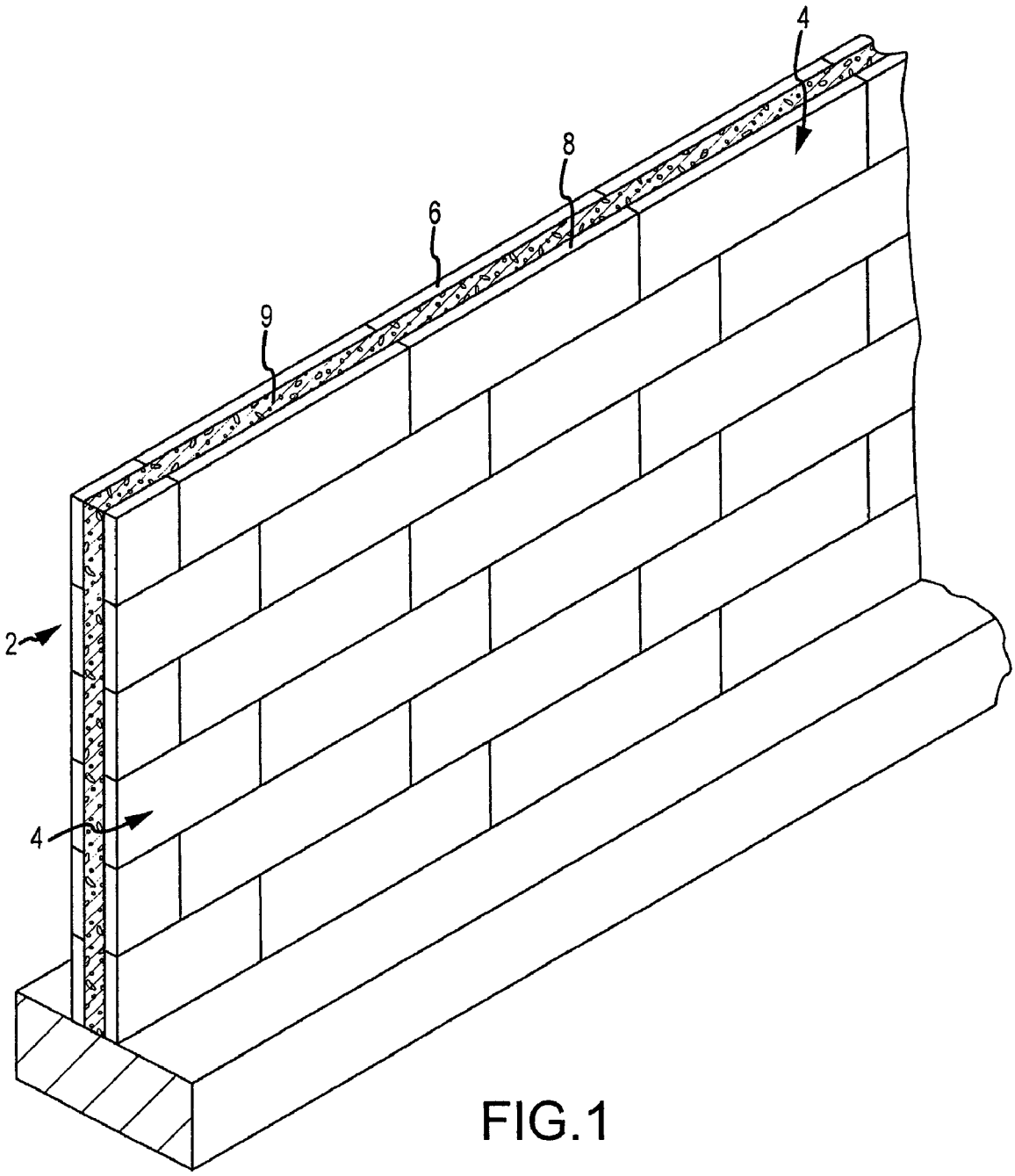
FIG. 1 is a fragmentary perspective view of an insulated concrete form wall where the concrete has been poured between the form sides.

Drawing Note: A wall section such as the one shown in the various Figures of the drawings is traditionally comprised of eight courses and the present invention is conceived to operate on such an eight course wall, but the wall levels shown in the drawings are shown with only six courses for purposes of simplifying the drawings.

DETAILED DESCRIPTION OF PREFERRED EMBODIMENT

For a detailed explanation of a preferred form of the ICF bracing and alignment device of the present invention, reference is made to the accompanying drawings.

FIG. 1 illustrates a fragmentary section of the poured base level 2 of a proposed multi-level insulated concrete form wall. The base level includes a plurality of stacked and mutually interlocked ICF modules 4 that each comprise inner and outer spaced apart foam sides 6 and 8. Poured and cured concrete 9 occupies the space between the sides of the formed wall. The insulating foam sides 6 and 8 are left in place following the curing of the concrete 9.

Figure 2:
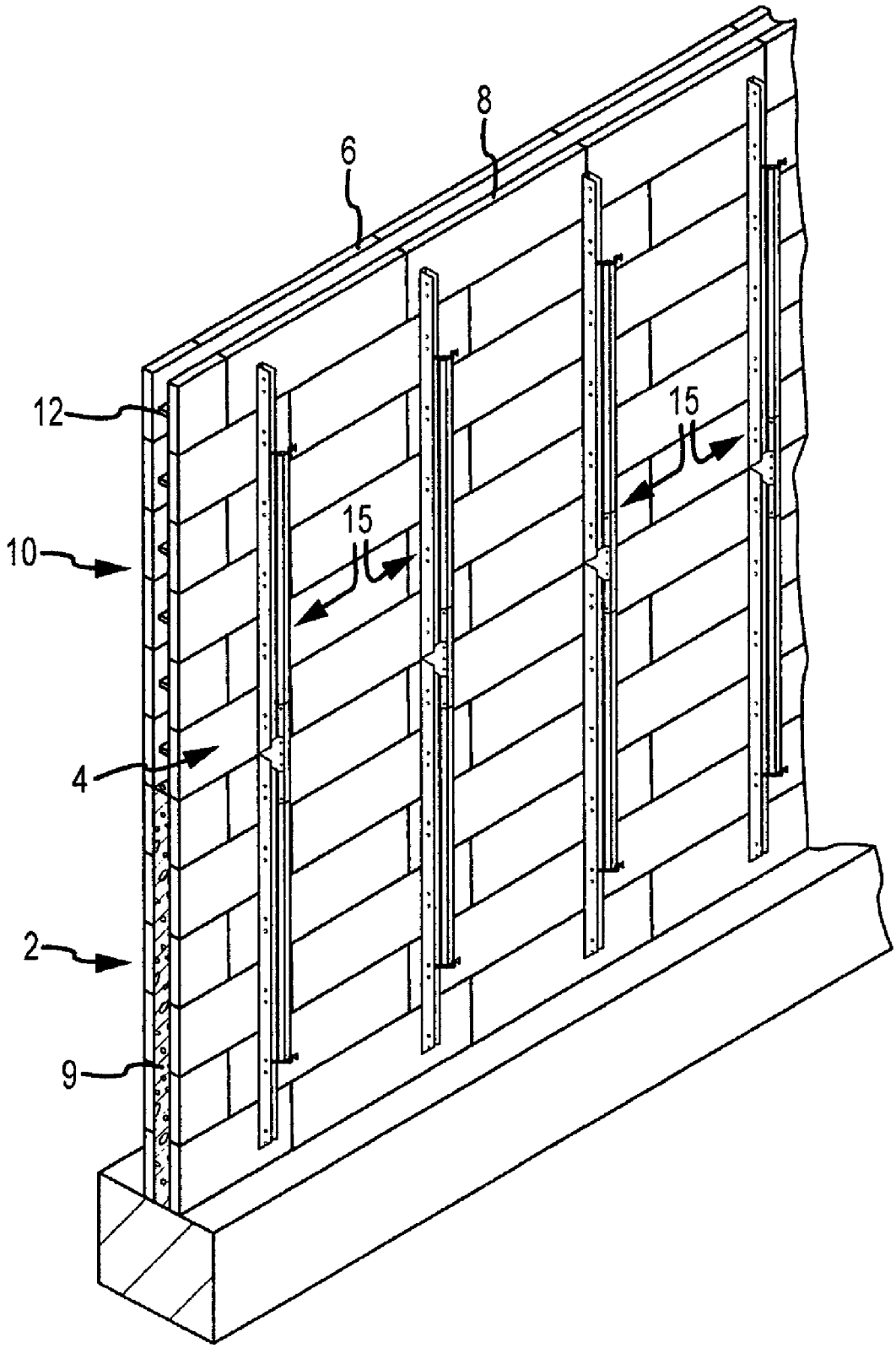
FIG. 2 is a fragmentary perspective view of an insulated concrete form wall under construction with the braces and alignment apparatus of the present invention. The lower half of the wall with cured concrete between the form sides is similar to the wall of FIG. 1 while the top half of the wall is formed but has not received concrete.

FIG. 2 illustrates the progression of the wall construction to the second level 10. The second level comprises a plurality of stacked mutual interlocking ICF modules 4 that are similar to the modules making up the base level 2. Each module 4 is traditional in its construction and comprises insulating foam sides 6 and 8 that are interconnected by a plurality of plastic or steel ties 12. Either during the stacking process or immediately thereafter a plurality of the brace and alignment devices 15 of the present invention are applied to one of the sides of the wall forms, as shown generally in FIG. 2 and which attachment is explained more fully below.

Figure 3:
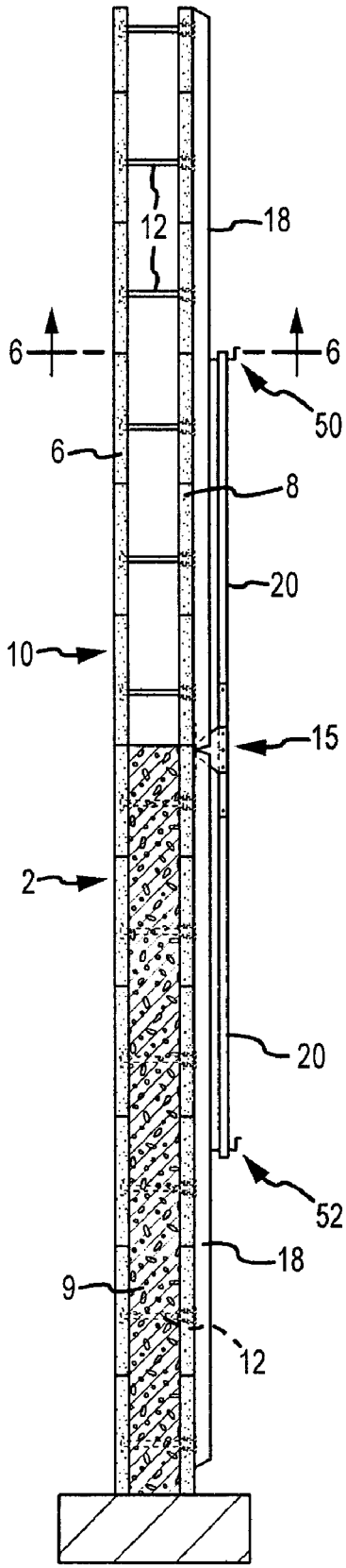
FIG. 3 is a vertical cross section of the insulated concrete form wall of FIG. 2.
Figure 4:
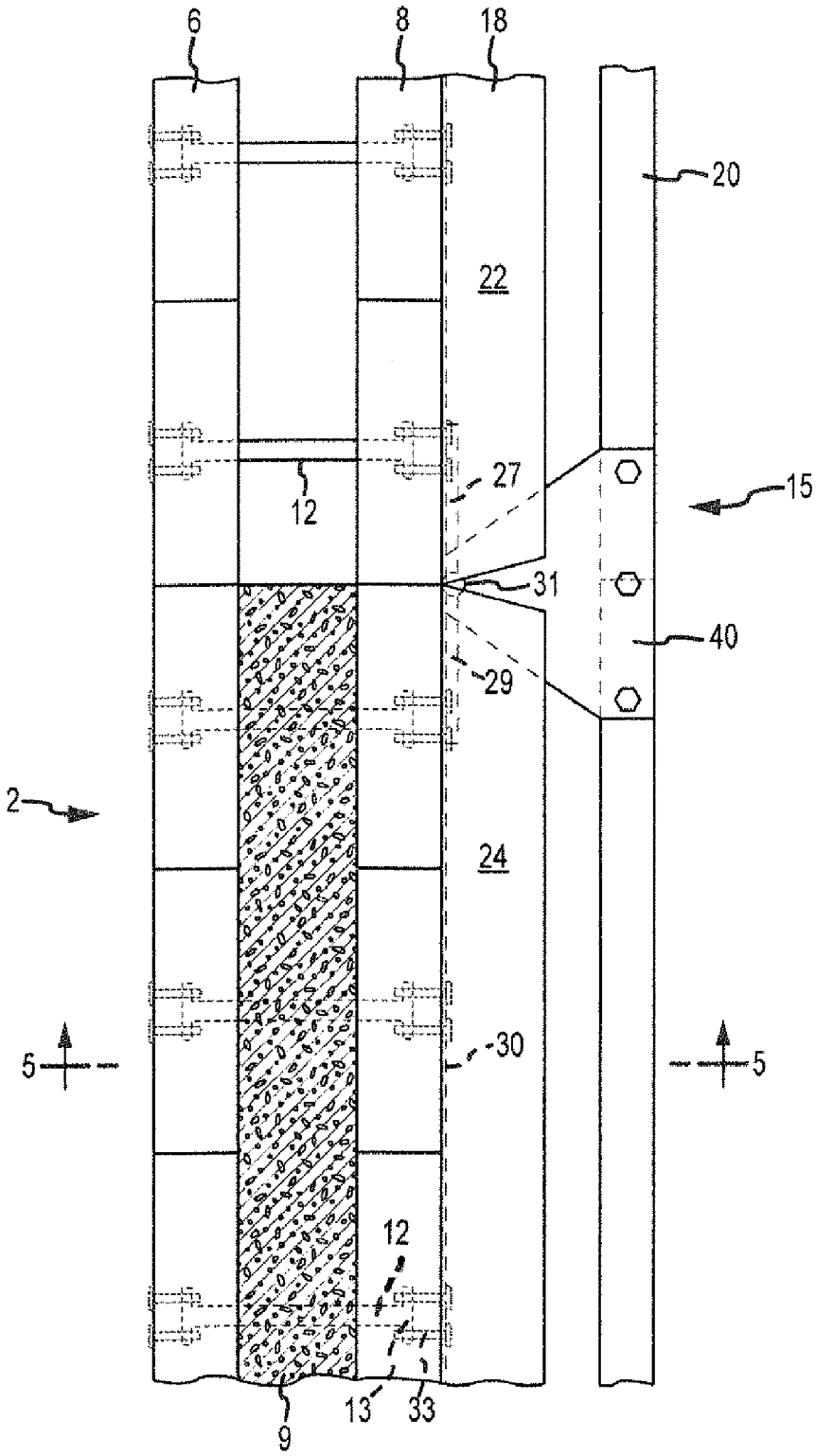
FIG. 4 is a fragmentary side view of the bracing and alignment apparatus of the present invention showing the method of attachment of the hinged bracing beam to the ties that interconnect the modules of insulated concrete form.

Turning now to FIGS. 3 and 4, a more detailed illustration of the brace and alignment device 15 is shown. The brace 15 comprises two co-planar elongated spaced apart beams, a bracing beam 18 and an alignment beam 20. The bracing beam 18 comprises first and second sections 22 and 24 of equal length that interconnect at their proximal ends by a hinge having leaves 27 and 29 that are attached to the bottom member 30 of the "U" shaped channel that forms the bracing beam 18. The hinge pin 31 forms a pivot point about which the first and second sections may make limited angular rotation with respect to one another. Slots are provided in the bottom member 30 of the bracing beam channel to receive screws 33 or similar fasteners that interconnect with the imbedded flat plate portion 13 of a tie 12 to secure the first section 24 of the bracing beam to the poured base wall 2 and to secure the second section 22 of the bracing beam 18 to the stacked modules 4 comprising the new unfinished level 10 of the wall.

Figure 5:
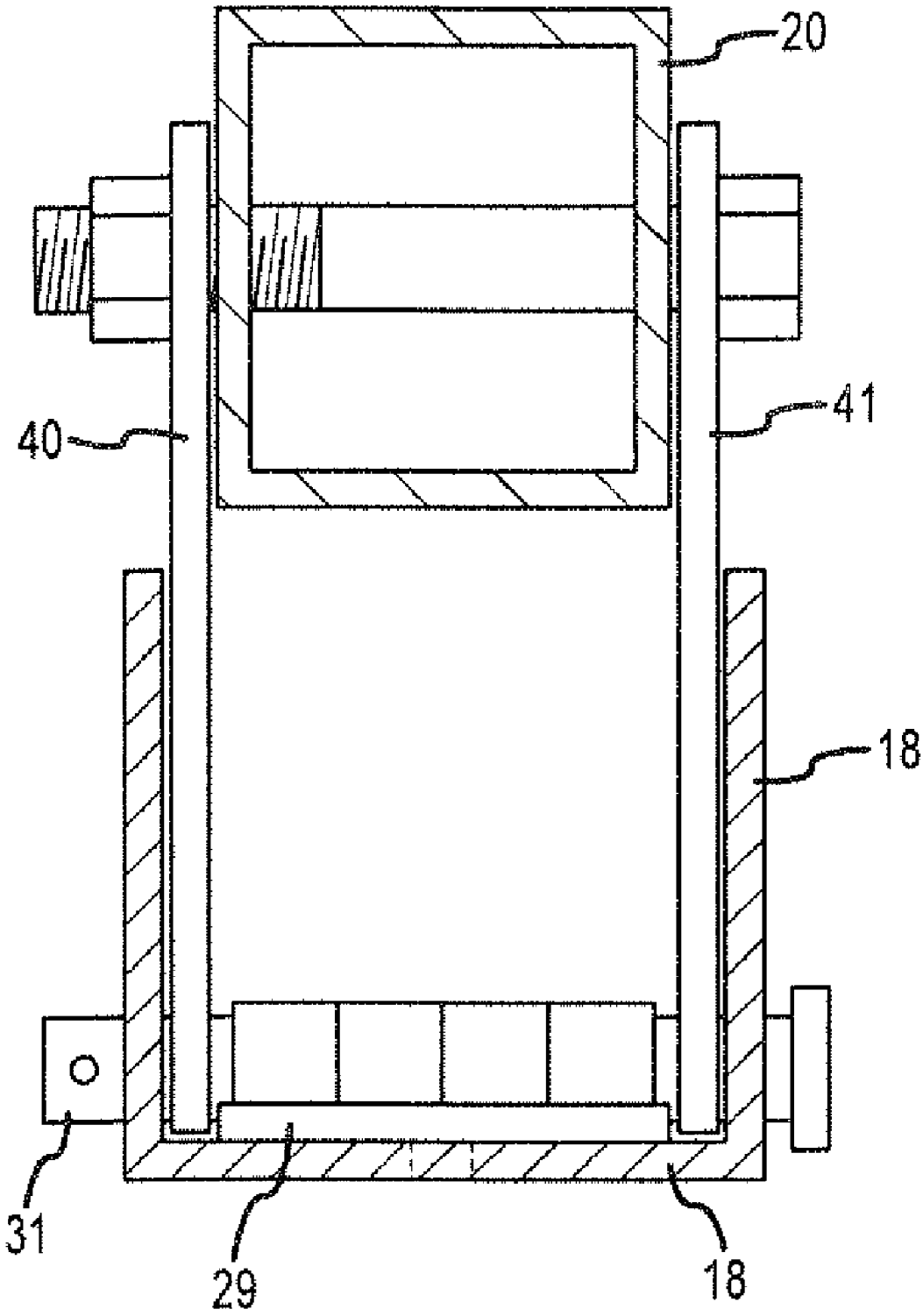
FIG. 5 is a cross sectional view taken along lines 5-5 of FIG. 4.

The alignment beam 20 is preferably a rigid tube of one piece, however it may comprise several sections and be formed of an I beam or similar structure. It is held in place by a bracket comprising two parallel substantially triangularly shaped plates 40 and 41 bolted at their bases to the opposing lateral sides of the central portion of the alignment beam 20. The apexes of the triangular bracket plates 40 and 41 are pivotally attached to the pivot pin 31 of the hinge that interconnects the first and second sections of the bracing beam 18, as shown best in FIGS. 4 and 5 by the hinged connection, second section 22 of the beam 18 can rotate to a limited extent with respect to the first section 24 that is secured to the poured level 2 of the wall.

Figure 6:
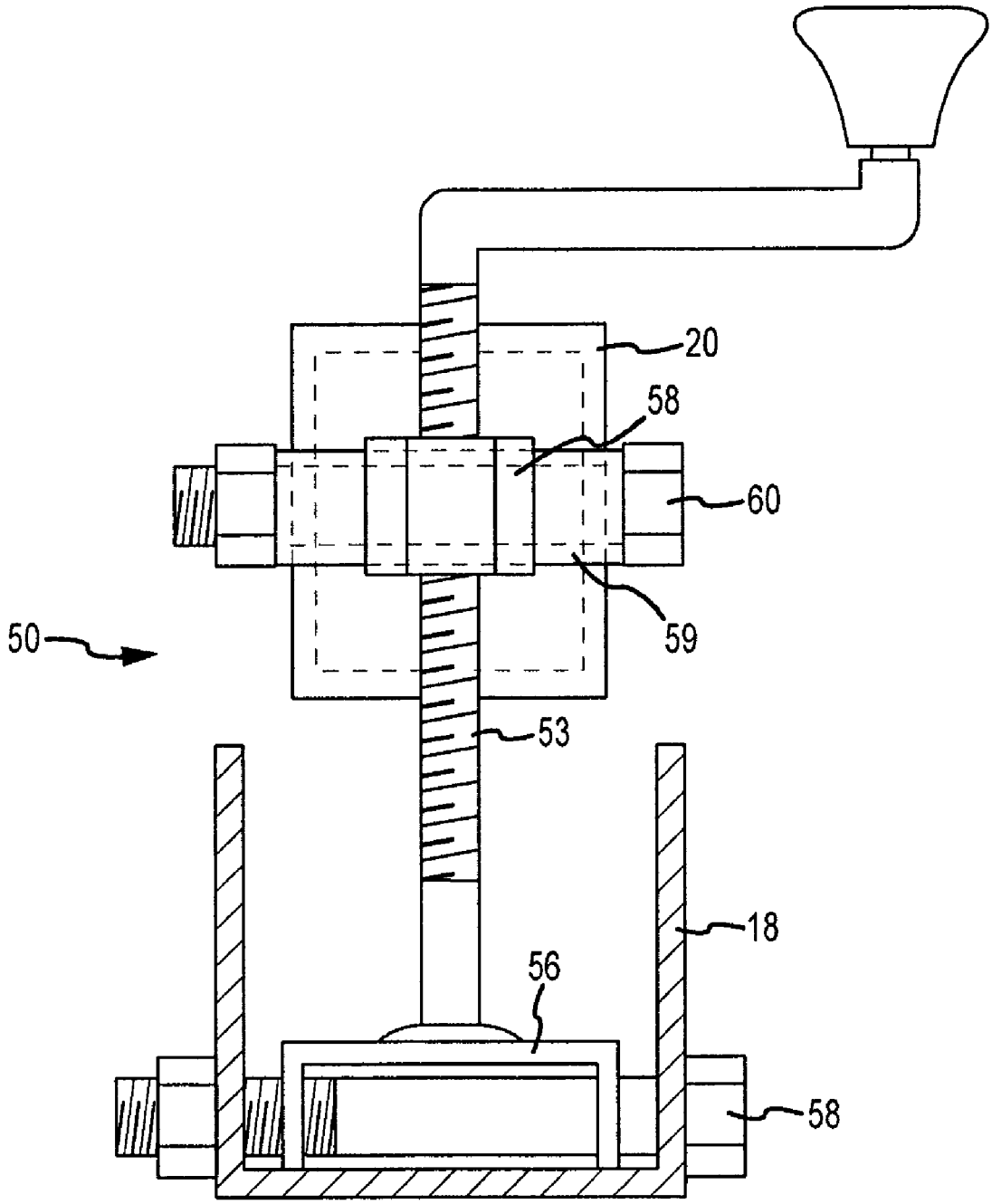
FIG. 6 is a cross section view of the adjusting assembly taken along lines 6-6 of FIG. 3.

Providing for rotation of a portion of alignment beam is the means by which the second section 22 of the bracing beam and its attached insulated wall are made plumb regardless of whether the base level wall 2 is plumb. Rotation of the alignment beam is realized through adjustment of the screw jack assemblies 50 and 52 located at the distal ends of the alignment beam 20, as shown in FIG. 6. The jack screw assemblies are alike and one will be described. There are multiple arrangements available for interconnecting the distal ends of the alignment and bracing beams with means for adjusting the spacing therebetween but a preferred form will be described. In FIG. 6 the alignment beam 20 is shown above the channel that forms the bracing beam 18. A rotatable jack screw 53 passes vertically through the interior of the alignment beam. The distal end of the screw 53 rotates against an inverted "U" shaped bracket 56 that is secured to the bottom of the bracing beam 18 with a bolt 58. The upper portion of the screw is threaded into a nut 58 that is attached to a "U" shaped bracket 59 the legs of which lie against the inside lateral walls of the tubular alignment brace 20 and are secured thereto by a bolt 60.

In operation, the distal end of the alignment tube 20 is made to move toward or retreat from the bracing beam 18 depending on the direction of rotation of the screw 53. When aligning the modules of the wall level that is under construction, adjustment of the screw 53 of the jack screw assembly 50 will either push the insulated forms back in one direction or pull them out in the opposite direction until the sides of the insulated forms are plumb. When the new section of the wall that is under construction is plumb the opposing jack screw assembly 52 is adjusted so that the lower ends of the beams are fixed in a tight relationship to one another so there is no play between the two lower ends. By making these adjustments of the jack screw assemblies 50 and 52 the alignment function of the wall brace is accomplished. Re-alignment may be necessary as the concrete is poured into the forms.

Although the drawings have depicted the poured level of a multi-level wall as being that level which is disposed directly on foundation footers it is to be understood that the poured level could be any one of the upper levels of a multi-level wall.

The primary method of the invention is to use a poured and cured level of a multi-level wall as the base or foundation to support bracing and alignment for the next succeeding wall level, thereby eliminating the need for diagonal ground based supporting struts. The method includes properly aligning, or plumbing, the upper section that is under construction regardless of the condition of plumb that may exist in the base level of the wall.

What is claimed is:

1. A method of constructing a multi-level insulated concrete form wall utilizing insulated concrete form modules, comprising the steps of, constructing a first level wall utilizing insulated concrete form modules, pouring and curing concrete disposed within the insulated form modules of the first level wall, constructing on top of the first level wall a second level wall utilizing insulated concrete form modules, anchoring a first of two aligned pivotally interconnected sections of a bracing beam to the modules of the first level wall, anchoring a second of the two aligned pivotally interconnected sections of the bracing beam to the modules of the second level wall, plumbing the second level wall with force applied to the second section of the bracing beam by first adjustment means carried by a first distal end of an elongated alignment beam pivotally disposed over the first and second sections of the bracing beam, and applying a counterforce to the alignment beam by second adjustment means carried by a second distal end of the alignment beam that is in contact with the first of the two aligned pivotally interconnected sections of the bracing beam.

2. The method of claim 1 and further including the steps of, pouring concrete into the insulated concrete form modules comprising the second level wall, and re-plumbing the second section of the bracing beam.

3. The method of claim 1 and further including repeating the steps of claim 1 for a third and succeeding wall levels where the second level wall and similar succeeding level walls take the place of the first level wall in claim 1.

* * * * *